United States Patent [19]

Illingworth

[11] Patent Number: 4,966,092

[45] Date of Patent: Oct. 30, 1990

[54] INTEGRAL GUNWALE CONSTRUCTION

[76] Inventor: William J. Illingworth, 1440 Justice Rd., Central Point, Oreg. 97502

[21] Appl. No.: 483,556

[22] Filed: Feb. 21, 1990

[51] Int. Cl.[5] ..... B63B 3/00

[52] U.S. Cl. ..... 114/356; 114/343

[58] Field of Search ..... 114/343, 347, 355–359, 114/65 R, 79 R; 428/599, 603; 256/59

[56] References Cited

U.S. PATENT DOCUMENTS

| | | | |
|---|---|---|---|
| 2,379,883 | 7/1945 | Clement, Jr. | 9/6 |
| 3,179,961 | 4/1965 | Ward et al. | 9/7 |
| 3,195,154 | 7/1965 | Swanson | 114/356 |
| 3,871,043 | 3/1975 | Davidson et al. | 114/356 |
| 3,943,586 | 3/1976 | Palmer | 9/6 |
| 4,599,963 | 7/1986 | Payne | 114/356 |
| 4,662,299 | 5/1987 | Eder et al. | 114/356 |
| 4,739,722 | 4/1988 | Rogstad | 114/356 |

*Primary Examiner*—Joseph F. Peters, Jr.
*Assistant Examiner*—Edwin L. Swinehart
*Attorney, Agent, or Firm*—Klarquist, Sparkman, Campbell, Leigh & Whinston

[57] ABSTRACT

An integral gunwale and handrail member for a boat, such as an aluminum river drift boat or motorboat, includes a gunwale member, a web member and a handrail member. The gunwale member includes generally longitudinally extending outboard and inboard wall members joined by at least one generally horizontal member. The gunwale member also includes attachment means for attaching the gunwale member to an upper edge of a side of the aluminum boat. The web member includes outboard and inboard edges, with the outboard edge of the web member being attached to the gunwale member inboard wall member. The handrail member is attached to the web member inboard edge. The handrail member includes at least one upright member extending upwardly above the web member so that the upright member may be grasped by an occupant of the boat. Also disclosed is a boat comprising a boat hull assembly having the integral gunwale and handrail member. Further disclosed is a method of making a contoured integral gunwale and handrail member using a bending jig member.

6 Claims, 4 Drawing Sheets

INTEGRAL GUNWALE CONSTRUCTION

BACKGROUND OF THE INVENTION

The present invention relates generally to boats, such as aluminum river drift boats and motorboats, and more particularly to an improved integral gunwale construction and method of forming the same for boats.

Other gunwale constructions have been used to strengthen and finish an upper edge of a side of a boat. For example, one known method of attaching a gunwale and handrail member to the upper edge of the sides of an aluminum boat comprises the steps of clamping prebent lengths of rectangular or round tubing to the outboard side of the boat along the upper edge.

Alternatively, the tubing may be prepared by cutting a continuous longitudinal slot along the length of the tubing. Assembly is then accomplished by inserting the upper edge into the tubing slot along the length of the boat side. The alternative steps of clamping or cutting a slot are each highly labor-intensive and time-consuming, since each require an accurate attention to detail to form a quality workpiece. Then the tubing, whether clamped or slotted, is welded to the side of the boat along the outboard side, thus forming the gunwale portion.

To provide an inboard handrail along the length of the boat side requires construction of an inner handrail assembly having a handrail with plural spacers welded thereto. The method of includes the steps of cutting a plurality of spacers, placing the spacers along the outboard side of the handrail, and individually welding each spacer to the handrail. Typically, such spacers are placed at approximately one foot intervals along the entire length of the boat side. Thus, this method requires extensive labor and attention to detail to cut, correctly place and weld each spacer to form the handrail assembly.

The inner handrail assembly is then clamped along the inboard side of the upper edge of the boat side. To assure proper placement of the handrail relative to the gunwale, a plurality of clamps are required, such as one clamp every six to twelve inches along the length of the boat side. After clamping, each spacer is individually welded to either the inboard side of the boat side, or the inboard side of the gunwale or both, as required by the particular design. Here, the welding step is especially labor-intensive, since each spacer must be welded within the close confines between the inboard side of the boat and the handrail member. Similar gunwale and handrail assemblies using a plurality of spacers are illustrated in U.S. Pat. No. 2,379,883 to Clement, Jr. and U.S. Pat. No. 3,943,586 to Palmer.

Another gunwale assembly is disclosed in U.S. Pat. No. 3,195,154 to Swanson for use with a boat having inner and outer sheet aluminum hulls with a rigid plastic core layer foamed in place therebetween. The Swanson gunwale includes a first channel for receiving the inner hull and a major portion of the plastic core and a second channel or slot for receiving the outer aluminum hull. The Swanson gunwale is secured in place by blind rivets driven through the outer hull and the walls of the second channel. The Swanson gunwale includes an outboard rub rail which is curled downward at its lower extremity to partially protect the boat hull from damage which might otherwise be caused by contact with the dock or other boats.

Another known gunwale assembly is disclosed in U.S. Pat. No. 3,179,961 to Ward et al., which includes a slotted portion for receiving an upper edge of a side of an aluminum boat. The Ward et al. gunwale includes a similar downwardly protruding outboard rail which may be used as a handrail. However, an occupant gripping such an outwardly protruding handrail may get pinched fingers if the boat is near a dock or other boats. Furthermore, one has to lean outwardly to grasp an outboard handrail, which may unbalance the boat.

Thus, a need exists for an improved integral gunwale and handrail member, a boat having such an integral member and a method of forming such an integral member for a boat, each of which are not susceptible to the above limitations and disadvantages.

SUMMARY OF THE INVENTION

It is an overall object of the present invention to provide an improved integral gunwale and handrail member for an aluminum boat.

A further object of the present invention is to provide an improved boat having an improved integral gunwale and handrail member.

An additional object of the present invention is to provide a method of making a contoured integral gunwale and handrail member for boats.

Yet another object of the present invention is to provide an integral gunwale and handrail member which may be quickly and easily installed on a boat.

Still another object of the present invention is to provide a boat having a gunwale and handrail member which is aesthetically pleasing as well as quickly and economically constructed.

According to one aspect of the present invention, an integral gunwale and handrail member is provided for an aluminum boat having a side with an upper edge. The integral member includes a generally longitudinally extending gunwale member. The gunwale member has a generally longitudinally extending outboard wall member and a generally longitudinally extending inboard wall member. The outboard and inboard wall members are joined by at least one generally horizontal member. The gunwale member also includes attachment means for attaching the gunwale member to the upper edge of the side of the aluminum boat. The integral member also includes a horizontal generally longitudinally extending web member having outboard and inboard edges. The outboard edge of the web member is attached to the inboard wall member of the gunwale member. The integral member also includes a generally longitudinally extending handrail member attached to the inboard edge of the web member. The handrail member includes at least one upright member, with the upright member extending upwardly above the web member. In this manner, the upright member may be grasped by an occupant of the boat.

In an illustrated embodiment, the gunwale and handrail member comprises an integral extrusion.

According to another aspect of the present invention, a boat is provided having a boat hull assembly including opposing first and second boat sides, with each boat side having an upper edge. The boat also includes first and second integral gunwale and handrail members, as described above. The attachment means of the first and second integral members receive the respective first and second boat side upper edges. The boat also includes securing means for securing first and second integral members to the respective first and second sides of the aluminum boat.

According to a further aspect of the present invention, a method is provided of making a contoured integral gunwale and handrail member for an aluminum boat having a side with a curved upper edge. The method includes the steps of providing an integral longitudinally extending member as described above. Another step of the method comprises providing a bending jig member including a contour-forming member having an upper surface with a curvature adapted to conform the attachment means of the integral member to a desire curvature. This desired curvature corresponds to the curved upper edge of the side of the aluminum boat. Following the steps of providing a jig member and integral member, in a placing step, the integral member is placed against the jig member with the handrail member in contact with the curved upper surface of the jig member. Finally, in a bending step, the integral member is bent around the jig member to form a contoured integral gunwale and handrail member having a curvature to conform the attachment means to the desired curvature corresponding to the curved upper edge of the side of the aluminum boat.

These and other objects, features and advantages of the present invention will become apparent to those skilled in the art from the following description and drawings.

DETAILED DESCRIPTION OF A PREFERRED EMBODIMENT

Figure 1:
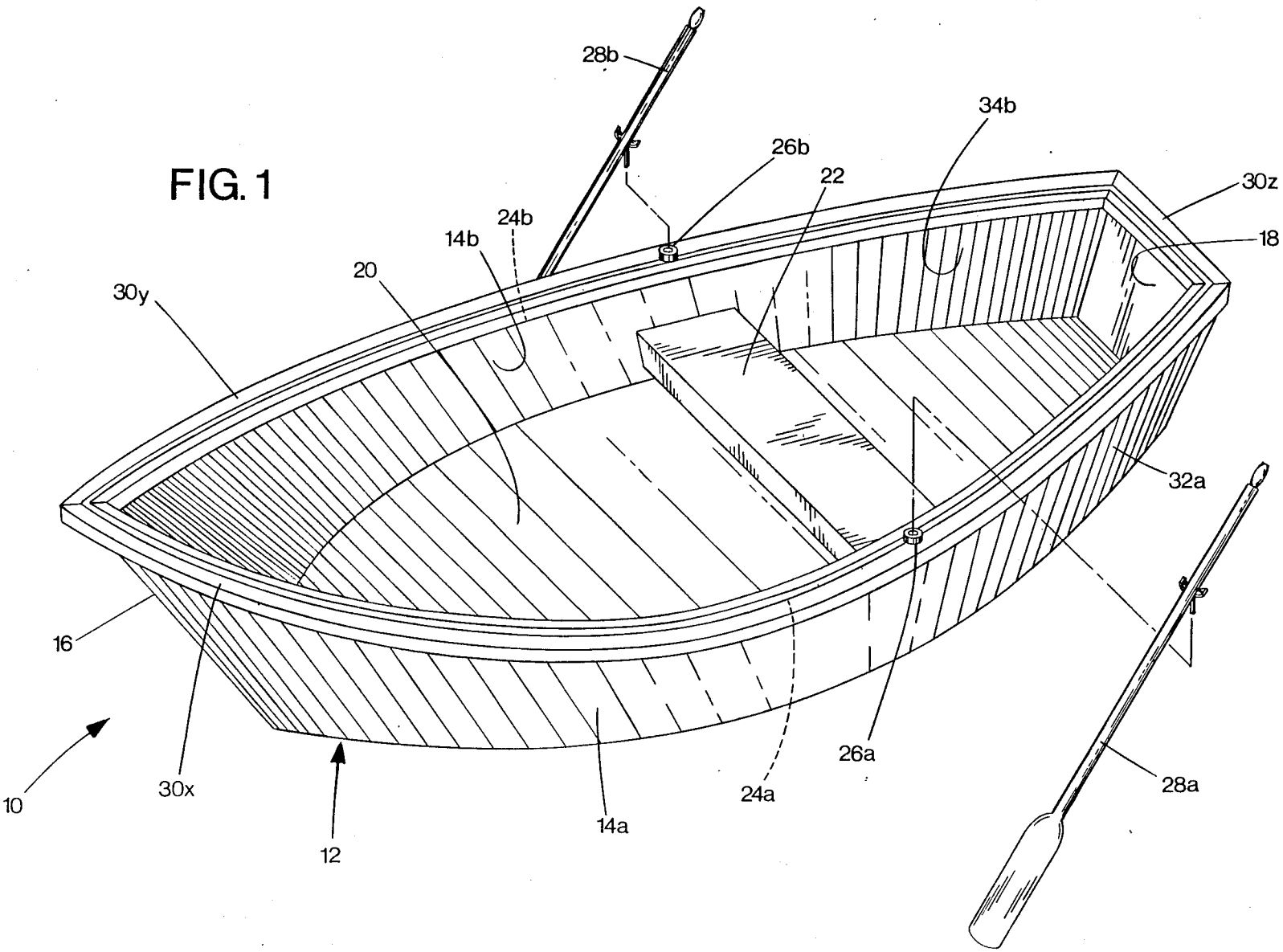
FIG. 1 is a perspective view of one form of a boat of the present invention.

FIG. 1 illustrates an embodiment of a boat, such as an aluminum river drift boat 10 having a hull assembly 12. The hull assembly 12 includes two opposing sides 14*a* and 14*b*. The sides 14*a* and 14*b* are joined at one end to form a bow 16, and are joined at the opposite end by a rear wall 18. The boat hull assembly also includes a bottom 20, and may also include one or more seats, such as seat 22, for an occupant of the boat. The boat sides 14*a* and 14*b* each have an upper edge 24*a* and 24*b*, respectively. The boat 10 may also include oar receiving means, such as 26*a* and 26*b*, to receive oars 28*a* and 28*b* respectively. Alternatively, the boat 10 may be a motorboat, with the rear wall 18 adapted to receive a motor (not shown) to power the boat.

Figure 2:
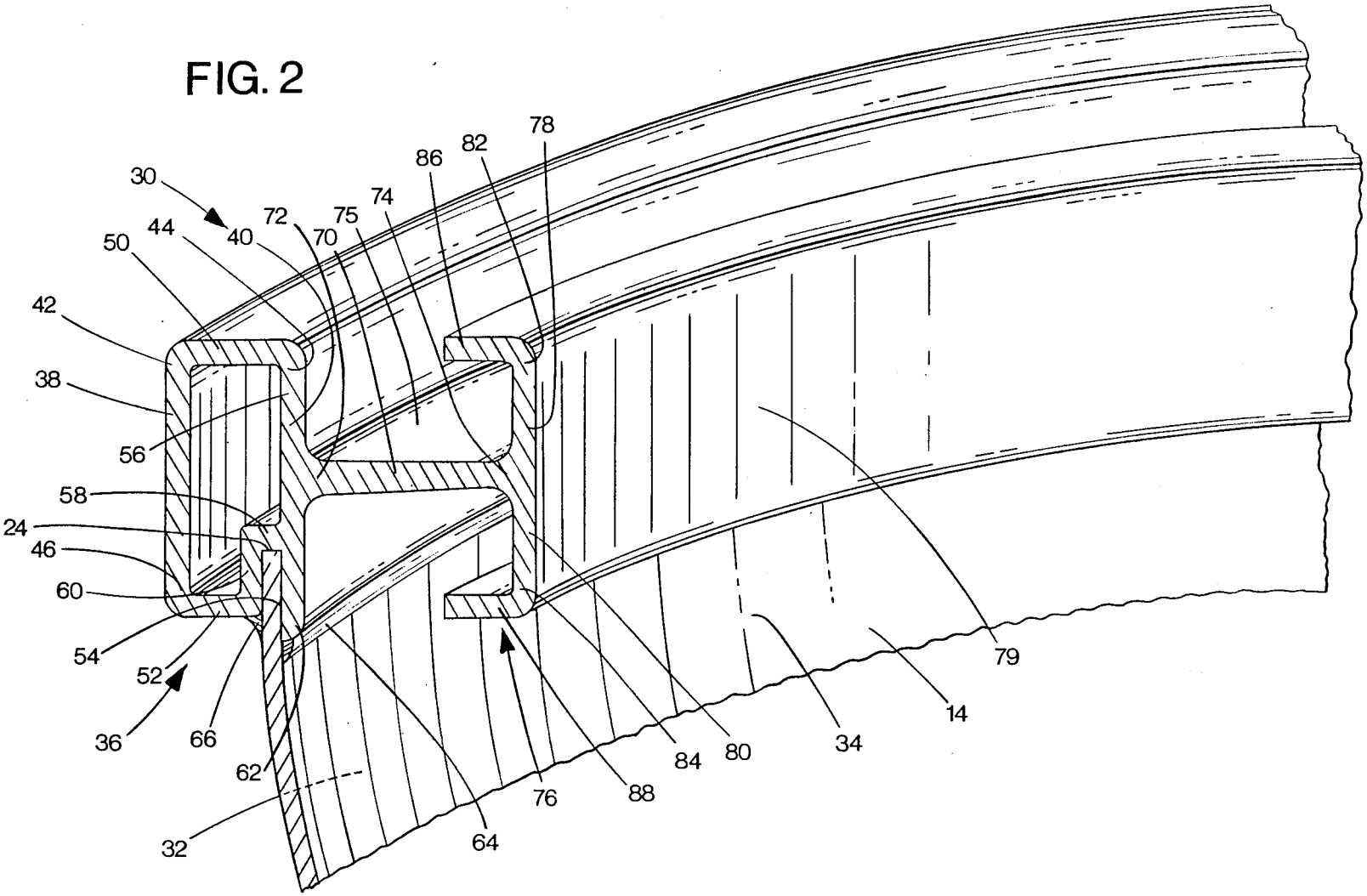
FIG. 2 is a cross-sectional cutaway perspective view of a boat side having one form of an integral gunwale and handrail member of the present invention.
Figure 3:
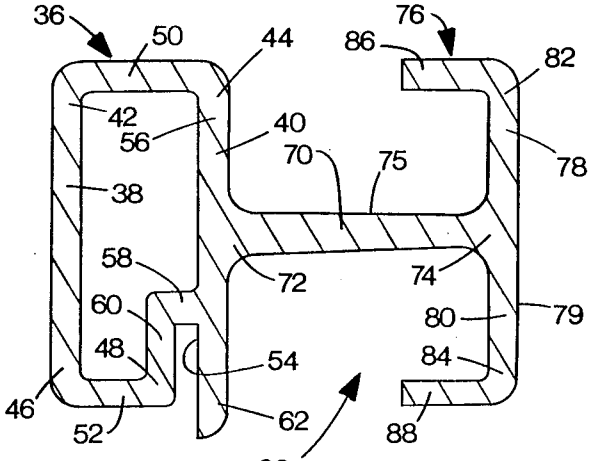
FIGS. 3 through 8 are cross-sectional views of alternate embodiments of an integral gunwale and handrail member of the present invention.

The boat 10 also includes first and second integral gunwale and handrail members 30*x* and 30*y*. The rear wall 18 may have a third integral gunwale and handrail member 30*z* along an upper edge thereof. Referring also now to FIGS. 2 and 3, the integral gunwale and handrail member, hereinafter the integral member 30, is shown attached to the upper edge 24 of the boat side 14. The boat side 14 has opposing outboard and inboard surfaces 32 and 34. The integral member 30 includes a generally longitudinally extending gunwale member 36.

The gunwale member 36 includes generally longitudinally extending opposing outboard and inboard wall members 38 and 40. The outboard and inboard wall members 38 and 40 may be substantially parallel to one another and of substantially the same length. The inboard and outboard wall members 38, 40 have respective upper edges 42, 44 and respective lower edges 46, 48. The inboard and outboard wall members 38, 40 are joined along their respective upper edges 42, 44 by a generally horizontal upper member 50 and along their respective lower edges 46, 48 by a generally horizontal lower member 52. The generally horizontal members 50 and 52 may be substantially perpendicular to the inboard and outboard wall members 38 and 40 to form a gunwale member having a rectangular cross section.

The gunwale member 36 also includes attachment means, such as a generally longitudinally extending channel member 54 adapted to receive the upper edge 24 of the side of the boat hull assembly 12. In the illustrated embodiment, the inboard wall member 40 includes an upper portion 56, a lateral middle portion 58 extending in an outboard direction from the upper portion 56, and a lower portion 60 extending between the middle portion 58 and the lower edge 48. The channel member 54 is formed by the inboard wall member middle portion 58 and lower portion 60 in combination with a downwardly extending lip 62. The lip 62 may be substantially coplanar with the inboard wall member upper portion 56. In the illustrated embodiment, the lip 62 extends downwardly beyond the outer surface of the lower horizontal member 52.

The boat 10 also includes securing means, such as the bead of weldment 64 for securing the integral member 30 to the boat side 14. The integral member 30 may also be welded along the boat side outboard surface 32, as illustrated by weldment 66. Other securing means may also be used, such as nuts and bolts, pop rivets, or adhesive means if appropriate; however, welding is preferred for the illustrated aluminum boat hull assembly.

The integral member 30 also includes a web portion, such as a single horizontal generally longitudinally extending web member 70. The web member 70 has outboard and inboard edges 72, 74 respectively, as well as an upper surface 75. The web member outboard edge 72 is attached to the gunwale member inboard wall member 40. The web member 70 may extend laterally from and be substantially perpendicular to the gunwale member inboard wall member 40.

The integral member 30 also includes handrail means, such as a generally longitudinally extending handrail member or assembly 76, attached to the inboard edge 74 of the web member 70. The handrail member 76 includes at least one upright upper member 78 extending upwardly above the web member 70. In the embodiment of FIGS. 2 and 3, the handrail member 76 also includes an upright lower member 80 extending downwardly beneath the web member 70, and being coplanar with the upright upper member 78 to form a single inboard-facing upright surface 79. The handrail upright upper and lower members 78 and 80 have respective upper and lower edges 82, 84 which join horizontal generally longitudinally extending handrail upper and lower members 86 and 88, respectively. In the preferred embodiment, the integral gunwale and handrail member 30 comprises an integral extrusion of an aluminum, such as aluminum alloy 6063 T4.

Figure 4:
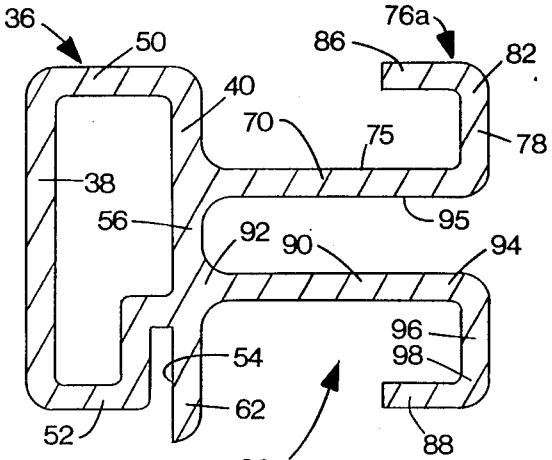

Referring now to the alternate embodiment of FIG. 4, the integral member 30*a* may include a second horizontal generally longitudinally extending web member 90 having outboard and inboard edges 92 and 94. The outboard edge 92 of the second web member 90 is attached to the inboard wall member 56 of the gunwale member 36. The first and second web members 70 and 90 in cooperation with the gunwale inboard wall member 56 form a storage channel 95. The storage channel 95 may be used by an occupant of the boat 10 to store small items, and particularly compressible items like gloves and other clothing, cork bobbers and the like.

In the FIG. 4 embodiment, the handrail assembly **76*a* includes a separate upright lower member 96 joined along the inboard edge 94 of the second web member 90 and extending downwardly therefrom. The separate upright lower member 96 has a lower edge 98 which joins the handrail lower horizontal member 88**.

Figure 5:
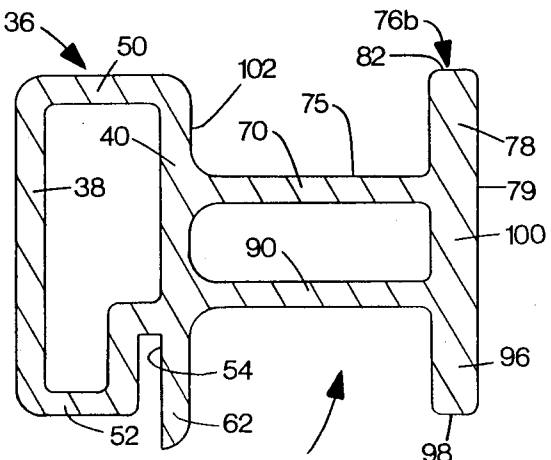

FIG. 5 illustrates an alternate integral member **30*b* having the first and second web members 70 and 90 as described above. The integral member 30*b* also includes a handrail assembly 76*b* having upright upper and lower members 78 and 96 interconnected by an upright medial member 100 to form the inboard-facing upright surface 79. Integral member 30*b* includes an upwardly opening C-channel 102 defined by surface 75 and walls 40 and 78. Note that this embodiment does not include the handrail upper horizontal member 86, and thereby allows for easier access to upper surface 75 of the first web member 70. Surface 75** may provide a convenient resting point for fishing bait and other items used by an occupant of the boat.

Figure 6:
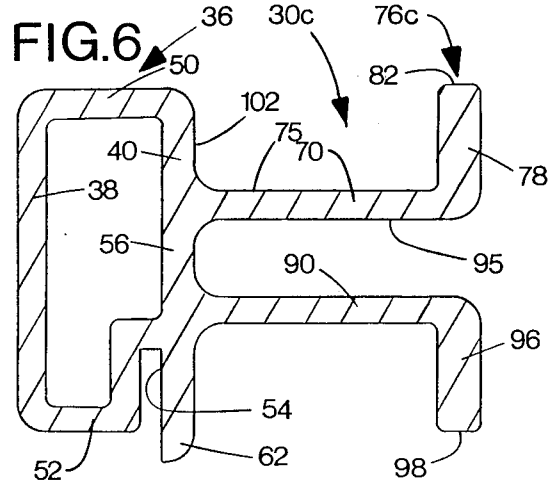

FIG. 6 illustrates an alternate integral member assembly **30*c* having first and second web members 70 and 90 and an alternate handrail assembly 76*c*. The handrail assembly 76*c* includes separate upright upper and lower members 78 and 96, as well as storage channel 95**.

Figure 7:
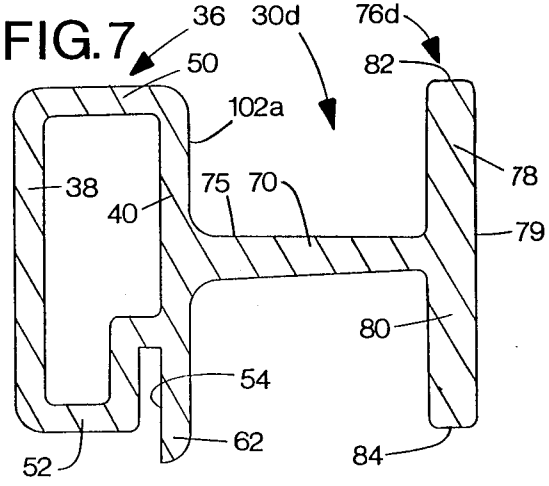

FIG. 7 illustrates an alternate integral member **30*d* having a single web member 70 and an alternate handrail assembly 76*d*. The handrail assembly 76*d* includes upright upper and lower members 78 and 80 forming the inboard-facing upright surface 79. Note that the lowered placement of the web member 70 of FIG. 7 as compared to that of FIGS. 5 or 6 provides a deeper upwardly opening Channel 102*a***.

Figure 8:
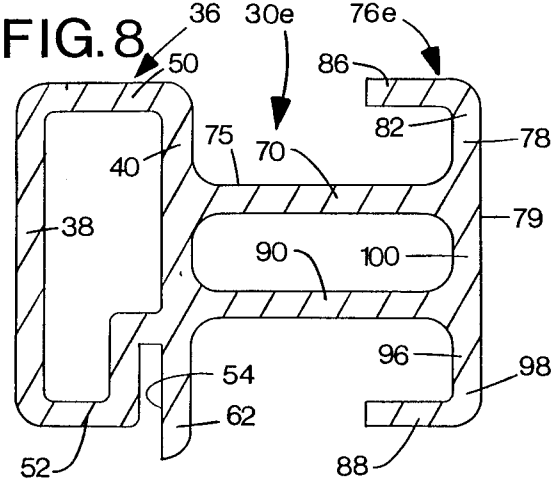

FIG. 8 illustrates an alternate integral member **30*e* having first and second web members 70 and 90 and an alternate handrail assembly 76*e*. The handrail assembly 76*e* includes upper, medial and lower coplanar upright members 78, 100 and 96, respectively, together forming the inboard-facing upright surface 79. The handrail assembly 76*e* also includes the upper and lower horizontal members 86 and 88**.

Figure 9:
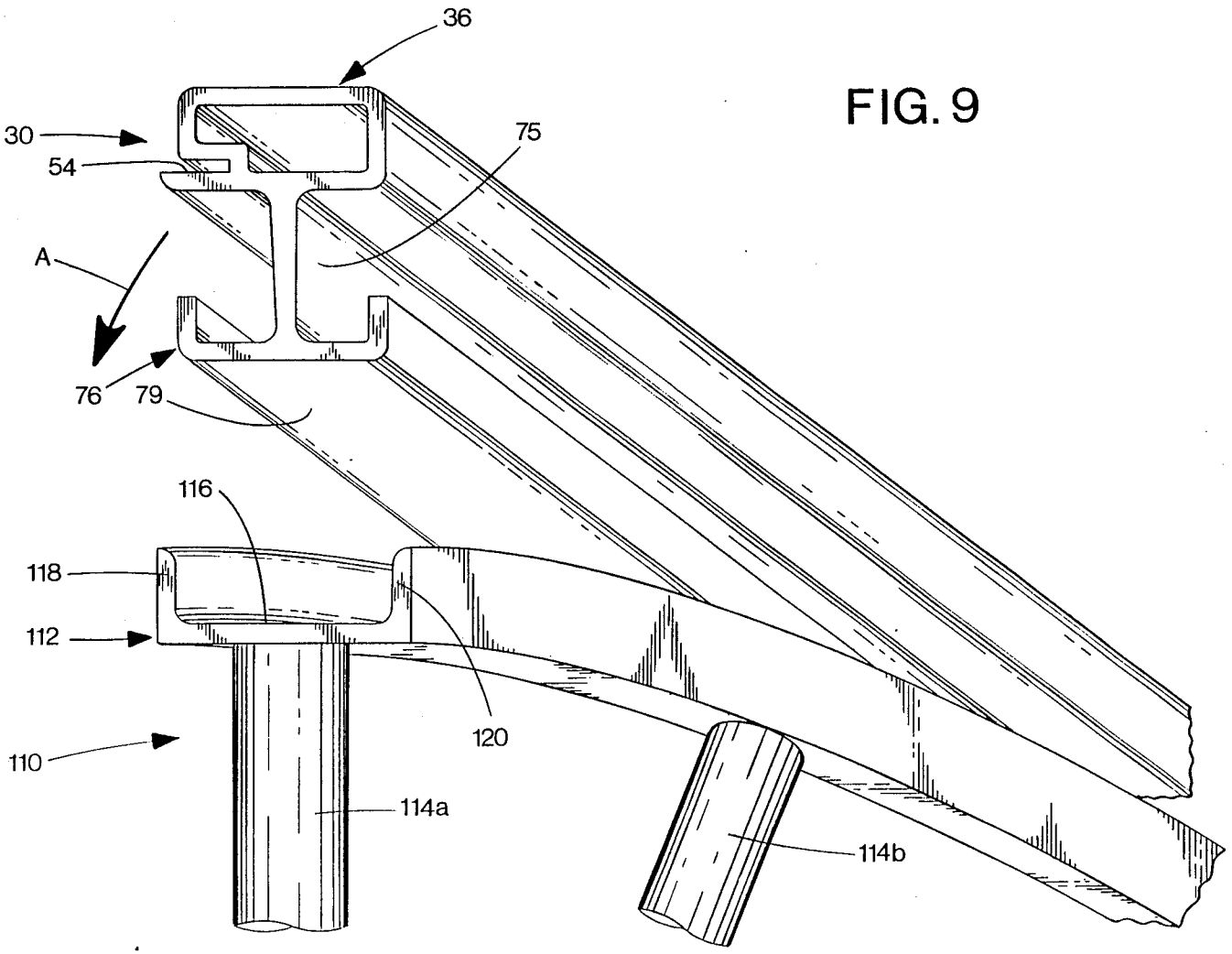
FIG. 9 is a partial detailed perspective view illustrating one form of a method of the present invention.

Referring now to FIG. 9, a method is illustrated of making a contoured integral gunwale and handrail member 30 for the boat 10 having side 14 with a curved upper edge 24. The method includes the step of providing the integral member 30, which may also be any of the alternate embodiments **30*a* through 30*e* as shown in FIGS. 4 through 8, member 110 having a contour-forming member 112 supported by support means including a plurality of support members such as 114*a* and 114*b*. The contour-forming member 112 has an upper surface 116 with two outwardly projecting opposing parallel alignment sides 118 and 120 defining an upper surface width therebetween to accommodate the handrail member 76. The jig upper surface 116 has a curvature adapted to conform the integral member attachment channel 54 to a desired curvature. This desired curvature corresponds to the curved upper edge 24 of the side 14 of the aluminum boat 10 when the handrail inboard-facing upright surface 79 is forced into contact with the bending jig upper surface 116. Thus, the curvature of the jig upper surface 116 is provided to accommodate for the length of the web member 70 (and 90 if applicable), so that once the integral member 30 is bent into shape against upper surface 116, the attachment channel 54 may slidably receive the boat side upper edge 24**.

The method also includes the step of placing a portion, such as one end, of the integral member 30 against the jig member 110 with the handrail inboard-facing upright surface 79 in contact with the curved upper surface 116 of the jig member. This portion of the integral member 30 may be secured to the jig member, such as by clamping (not shown). The method further includes the step of bending the integral member 30 around the jig member 110, such as by manually, hydraulically or otherwise forcing the length of the handrail assembly, 76 in the direction indicated by arrow A into contact with the jig upper surface 116.

The boat 10 may then be assembled by placing the attachment channel 54 of the bent integral member 30 over the boat side upper edge 24 so the channel 54 may slidably receive edge 24. The integral member 30 is then secured in place on the boat such as by welding to form weldment 64 and/or 66 (see FIG. 2). In this manner, the integral member 30 finishes the upper edge 24, adds rigidity to the boat side 14 and defines the contour of the boat 10.

Having illustrated and described the principles of my invention with respect to several preferred embodiments, it should be apparent to those skilled in the art that my invention may be modified in arrangement and detail without departing from such principles. For example, boats other than aluminum boats, such as boats having a boat hull assembly of fiberglass, may use my integral gunwale and handrail member. Other suitable material substitutions and dimensional variations for the elements of my integral gunwale and handrail member may also be employed. I claim all such modifications falling within the scope and spirit of the following claims.

I claim:

1. An integral gunwale and handrail member for an aluminum boat having a side with an upper edge, comprising:

a generally longitudinally extending gunwale member, the gunwale member comprising a generally longitudinally extending outboard wall member and a generally longitudinally extending inboard wall member, said outboard and inboard wall members being joined by at least one generally horizontal member, the gunwale member further comprising attachment means for attaching said gunwale member to the upper edge of the side of the aluminum boat;

a horizontal generally longitudinally extending web member having outboard and inboard edges, the outboard edge of said web member being attached to the inboard wall member of the gunwale member; and a generally longitudinally extending handrail member attached to the inboard edge of the web member, the handrail member comprising at least one upright member, the upright member extending upwardly above the web member, whereby the upright member may be grasped by an occupant of the boat.

2. An integral gunwale and handrail member as in claim 1, wherein said gunwale and handrail member comprises an integral extrusion.

3. An integral gunwale and handrail member as in claim 1, wherein said outboard and inboard wall members each have an upper edge, and said outboard and inboard wall members are joined at their upper edges by said one generally horizontal member.

4. An integral gunwale and handrail member as in claim 3, wherein said outboard and inboard wall members each have a lower edge, said gunwale member further comprises a second generally horizontal member, and said second generally horizontal member joins said outboard and inboard wall members at their lower edges.

5. An integral gunwale and handrail member as in claim 4, wherein said attachment means comprises a generally longitudinally extending channel member, said channel member adapted to receive the upper edge of the side of the aluminum boat.

6. A boat comprising:

a boat hull assembly including opposing first and second boat sides, with each boat side having an upper edge;

first and second integral gunwale and handrail members with each comprising:

(a) a generally longitudinally extending gunwale member, the gunwale member comprising a generally longitudinally extending outboard wall member and a generally longitudinally extending inboard wall member, said outboard and inboard wall members being joined by at least one generally horizontal member, the gunwale member further comprising attachment means for attaching said gunwale member to an upper edge of a side of the boat hull assembly;

(b) a horizontal generally longitudinally extending web member having outboard and inboard edges, the outboard edge of said web member being attached to the inboard wall member of the gunwale member; and (c) a generally longitudinally extending handrail member attached to the inboard edge of the web member, the handrail member comprising at least one upright member, the upright member extending upwardly above the web member;

the attachment means of the first and second integral gunwale and handrail members receiving the respective first and second boat side upper edges; and securing means for securing the first and second integral gunwale and handrail members to the respective first and second sides of the aluminum boat.

* * * * *

UNITED STATES PATENT AND TRADEMARK OFFICE

CERTIFICATE OF CORRECTION

PATENT NO. : 4,966,092

DATED : October 30, 1990

INVENTOR(S) : William J. Illingworth

It is certified that error appears in the above-identified patent and that said Letters Patent is hereby corrected as shown below:

Column 5, line 43, "Channel" should be --C-channel--;

Column 5, line 58, after "8" insert a period (--.--); and

Column 5, line 58, before "member 110" insert as a new paragraph --The method also includes the step of providing a bending jig--.

Signed and Sealed this

Twelfth Day of May, 1992

*Attest:*

DOUGLAS B. COMER

*Attesting Officer*

*Acting Commissioner of Patents and Trademarks*